US006661186B2

(12) United States Patent
Nakamura et al.

(10) Patent No.: US 6,661,186 B2
(45) Date of Patent: Dec. 9, 2003

(54) COLOR CATHODE RAY TUBE, DRIVING CIRCUIT THEREFOR, COLOR IMAGE REPRODUCING DEVICE EMPLOYING THE DRIVING CIRCUIT, AND COLOR IMAGE REPRODUCING SYSTEM INCLUDING THE COLOR IMAGE REPRODUCING DEVICE

(75) Inventors: Tomoki Nakamura, Mobara (JP); Hirotsugu Sakamoto, Chiba (JP); Shinichi Kato, Mobara (JP); Syoji Shirai, Mobara (JP)

(73) Assignees: Hitachi, Ltd., Tokyo (JP); Hitachi Device Engineering Co., Ltd., Mobara (JP)

( * ) Notice: Subject to any disclaimer, the term of this patent is extended or adjusted under 35 U.S.C. 154(b) by 16 days.

(21) Appl. No.: 10/020,978

(22) Filed: Dec. 19, 2001

(65) Prior Publication Data

US 2002/0140382 A1 Oct. 3, 2002

(30) Foreign Application Priority Data

Dec. 25, 2000 (JP) ..... 2000-392008

(51) Int. Cl.[7] ..... H01J 29/70
(52) U.S. Cl. ..... 315/364; 315/366; 315/382
(58) Field of Search ..... 315/364, 366, 315/376, 381, 382, 383, 399; H01J 29/70

(56) References Cited

U.S. PATENT DOCUMENTS 3,609,447 A * 9/1971 Hirota ..... 315/27
3,887,838 A * 6/1975 Thurston ..... 315/376
4,987,350 A * 1/1991 Hartmann et al. ..... 315/382
5,210,472 A * 5/1993 Casper et al. ..... 315/349
5,491,382 A * 2/1996 Shimokobe et al. ..... 315/17

FOREIGN PATENT DOCUMENTS

JP 09191462 * 7/1997 ..... H04N/9/00

* cited by examiner

*Primary Examiner*—Tho Phan
(74) *Attorney, Agent, or Firm*—Antonelli, Terry, Stout & Kraus, LLP

(57) ABSTRACT

A color cathode ray tube has an electron gun including three in-line cathodes, first and second grid electrodes arranged in the order named, and plural electrodes for focusing three electron beams from the cathodes onto the phosphor screen. The following inequalities are satisfied: $E \leqq 1.4A-0.2B-2.7C-2D$, and $A \leqq 0.35$ mm, where A (mm) is a diameter of an electron-beam transmissive aperture in the first grid electrode, B (mm) is a diameter of an electron-beam transmissive aperture in the second grid electrode, C (mm) is a thickness of a portion of the first grid electrode immediately surrounding the electron-beam transmissive aperture in the first grid electrode, D (mm) is a spacing between the cathodes and the electron-beam transmissive aperture in the first grid electrode, and E (mm) is a spacing between the first grid electrode and the second grid electrode.

1 Claim, 14 Drawing Sheets

COLOR CATHODE RAY TUBE, DRIVING CIRCUIT THEREFOR, COLOR IMAGE REPRODUCING DEVICE EMPLOYING THE DRIVING CIRCUIT, AND COLOR IMAGE REPRODUCING SYSTEM INCLUDING THE COLOR IMAGE REPRODUCING DEVICE

BACKGROUND OF THE INVENTION

The present invention relates to a color cathode ray tube, a circuit for driving a color cathode ray tube, a color image reproducing device employing the circuit and a color image reproducing system including the color image reproducing device, which are capable of switching between displaying a high-brightness image and displaying a high-definition image.

As for electronic apparatuses employing color cathode ray tubes, television receivers and display monitors of terminals for information equipment represented by personal computers are placed as separate articles of commerce on the market.

The display monitors for information terminals are required to provide high-definition images, and it is essential that they have high resolution capability. Therefore the display monitors needs to be driven at high frequencies (high deflection frequencies), and produce sufficiently small electron beam spots. Priority is given to reduction of electron beam spots, and as a result their display brightness and contrast are set to be lower than those of the television receivers.

On the other hand, first of all, high brightness and high contrast are required of the color television receivers so as to present realism in their scenes, and since the frequencies are prescribed by the color television systems such as NTSC, PAL and SECAM, the degree of image definition is not valued so highly as in the case of the display monitors for information terminals. As a result scene brightness and display contrast have priority over electron beam spot diameters, and therefore it is important to obtain large currents.

In present systems which includes a display monitor for an information terminal and is also configured so as to be capable of receiving television broadcasts by using the display monitor, when they receive television broadcast, the display monitor have to increase electron beam spot diameters compared with those of the display monitor used for the information terminal, or reduce scene brightness and display contrast compared with those of color television receivers.

FIG. 15 is an illustration of an example of a relationship between cathode cutoff voltages and cathode currents with a fixed drive voltage of 40 V in color cathode ray tubes, with the abscissa representing cathode cutoff voltages Ekco (V) and the ordinate representing cathode currents Ik (mA). A drive voltage Ed is defined as a difference (Ekco−Ek) between a cathode voltage Ek for producing the amount of an electron beam current corresponding to a video signal and a cutoff voltage (Ekco), as explained subsequently in connection with FIG. 5. In one color cathode ray tube, when a voltage Ec1 applied on the first grid electrode is fixed, the cutoff voltage Ekco increases as the voltage Ec2 on the second grid electrode is increased. To increase a cathode current with the fixed drive voltage, the cutoff voltage Ekco needs to be lowered, in other words, the voltage Ec2 needs to be lowered.

FIG. 16 is an illustration of an example of a relationship between cutoff voltages and electron beam spot diameters for color cathode ray tubes, with the abscissa representing cathode cutoff voltages Ekco (V) and the ordinate representing electron beam spot diameters (mm) at the 10% intensity profile.

As is apparent from FIG. 16, to produce electron beam spot diameters corresponding to a high-resolution display, the cutoff voltages Ekco needs to be sufficiently high, and hence the second grid electrode voltage Ec2 needs to be sufficiently high.

FIG. 17 is an illustration of examples of a conventional color cathode ray tube and a conventional driving circuit for diving the color cathode ray tube used in conventional color TV receivers or conventional display monitors of information terminals. Reference numeral 20 denotes a color cathode ray tube, 21, 21' and 21" are cathodes for red, green and blue electron beams, respectively, 22 is the first grid electrode, 23 is the second grid electrode, 24 is the third grid electrode, and 25, 26 and 27 are output transistors for red, green and blue signals, respectively. The fourth grid electrode and grid electrodes succeeding it in the electron gun are omitted in FIG. 17.

Reference numeral 1 denotes a variable resistor for setting cutoff voltages of three electron guns by adjusting a voltage applied on the second grid electrode 23, and 2, 3 and 4 are variable resistors for adjusting voltages applied on emitters of the output transistors 25, 26 and 27 for the red, green and blue signals, respectively, such that voltages on the cathodes 21, 21' and 21" are adjusted independently of each other, thereby to absorb differences in cutoff voltages among the three electron guns. Reference numerals 5 and 6 are variable resistors for adjusting the magnitude of drive voltages applied on cathodes 21 and 21", respectively, and 8 is a variable resistor for adjusting a voltage applied on the third grid electrode 24.

The color cathode ray tube 20 employs three electron guns, and the three electron guns differ in characteristics from each other because of a slight structural variability among the three assembled electron guns, and further, red, green and blue color phosphors of the color cathode ray tube 20 differ in luminous efficiency, and therefore voltages applied on the three cathodes are adjusted to compensate for the differences in the characteristics such that the three electron beams are adjusted in amount and thereby the three colors produced by the three electron beams balance with each other regardless of the scene brightness.

Generally the three electron guns for the three electron beams, respectively, are fabricated as an integral structure, and the electrodes other than the cathodes 21, 21' and 21" are fabricated for the three electron beams in common. Therefore, white balance adjustment for the three colors is made mainly by adjusting the cathode voltages.

In the circuit configuration shown in FIG. 17, a combination of the maximum magnitudes of the voltages on the second grid electrode 23, the three cutoff voltages and the magnitudes of the three drive voltages is necessarily determined, and hence can not be changed freely.

Consequently, a high-definition display required of the display monitors of information terminals and a high-brightness and high-contrast display required of the color television receiver could not be realized by one apparatus.

The conventional technique of this kind is disclosed in Japanese Patent Application Laid-open No. Hei 9-191462 assigned to the assignee of the present invention.

SUMMARY OF THE INVENTION

As described above, with the conventional technique, it was impossible to switch between a high-brightness display and a high-definition display by using one driving circuit for a color cathode ray tube, and therefore it has been a problem to make it possible to perform two functions required of a display monitor of an information terminal and a color television receiver, respectively, by using one apparatus.

It is an object of the present invention to provide a color cathode ray tube, a circuit for driving a color cathode ray tube, a color image reproducing device employing the circuit and a color image reproducing system including the color image reproducing device, which make it possible to switch between a plurality of driving modes such that one apparatus can perform two functions required of display monitors of various information terminals and color television receivers for various color television systems, by solving the above problems with the conventional technique.

The following are representative ones of a color cathode ray tube, a circuit for driving a color cathode ray tube, a color image reproducing device employing the circuit and a color image reproducing system including the color image reproducing device, in accordance with the present invention.

In accordance with an embodiment of the present invention, there is provided a color cathode ray tube having a phosphor screen and an electron gun, the electron gun comprising: a triode section including three transversely-spaced in-line cathodes adapted to be supplied with video signals, a first grid electrode and a second grid electrode arranged in the order named; and a plurality of electrodes for focusing three electron beams emitted from the triode section onto the phosphor screen, wherein the following inequalities are satisfied: $E \leqq 1.4A-0.2B-2.7C-2D$, $A \leqq 0.35$ mm, where A (mm) is a diameter of an electron-beam transmissive aperture in the first grid electrode, B (mm) is a diameter of an electron-beam transmissive aperture in the second grid electrode, C (mm) is a thickness of a portion of the first grid electrode immediately surrounding the electron-beam transmissive aperture in the first grid electrode, D (mm) is a spacing between the three transversely-spaced in-line cathodes and the electron-beam transmissive aperture in the first grid electrode, and E (mm) is a spacing between the first grid electrode and the second grid electrode.

In accordance with another embodiment of the present invention, there is a driving circuit for driving a color cathode ray tube including a voltage-setting circuit for setting voltages to be applied on cathodes and electrodes of the color cathode ray tube having three cathodes for emitting three electron beams and adapted to be supplied with video signals, a first grid electrode for the three electron beams in common, and a second grid electrode for the three electron beams in common, arranged in the order named, the voltage-setting circuit comprising: a circuit configured to provide a plurality of combinations of three cathode bias voltages to be applied on the three cathodes, respectively, a first grid electrode voltage to be applied on the first grid electrode and a second grid electrode voltage to be applied on the second grid electrode; and a switching circuit for selecting one of the plurality of combinations such that a voltage difference between the second grid electrode voltage and the first grid electrode voltage increases when a horizontal deflection frequency of the three electron beams is increased.

In accordance with another embodiment of the present invention, there is a driving circuit for driving a color cathode ray tube including a voltage-setting circuit for setting voltages to be applied on cathodes and electrodes of a three-electron-beam color cathode ray tube having three cathodes for emitting three electron beams and adapted to be supplied with video signals, a first grid electrode for the three electron beams in common, and a second grid electrode for the three electron beams in common, arranged in the order named, the voltage-setting circuit comprising: a circuit configured to provide a plurality of combinations of three cathode bias voltages to be applied on the three cathodes, respectively, and a second grid electrode voltage to be applied on the second grid electrode, with a first grid electrode voltage to be applied on the first grid electrode being fixed; and a switching circuit for selecting one of the plurality of combinations such that the second grid electrode voltage increases when a horizontal deflection frequency of the three electron beams is increased.

In accordance with another embodiment of the present invention, there is a driving circuit for driving a color cathode ray tube including a voltage-setting circuit for setting voltages to be applied on cathodes and electrodes of the color cathode ray tube having three cathodes for emitting three electron beams and adapted to be supplied with video signals, a first grid electrode for the three electron beams in common, and a second grid electrode for the three electron beams in common, arranged in the order named, the voltage-setting circuit comprising: a circuit configured to provide continuously adjustable voltages to at least one of the three cathode, and at least one of the first grid electrode and the second grid electrode; and a voltage control circuit for controlling the continuously adjustable voltages such that a voltage difference between the second grid electrode and the first grid electrode increases when a horizontal deflection frequency of the three electron beams is increased.

The present invention is not limited to the above configurations or the configurations of the embodiments described subsequently, and various changes and modifications may be made without departing from the spirit and scope of the present invention.

BRIEF DESCRIPTION OF THE DRAWINGS

In the accompanying drawings, in which like reference numerals designate similar components throughout the figures, and in which.

DETAILED DESCRIPTION OF THE PREFERRED EMBODIMENTS

The following describes the embodiments in accordance with the present invention in detail by reference to the drawings.

Figure 1A:
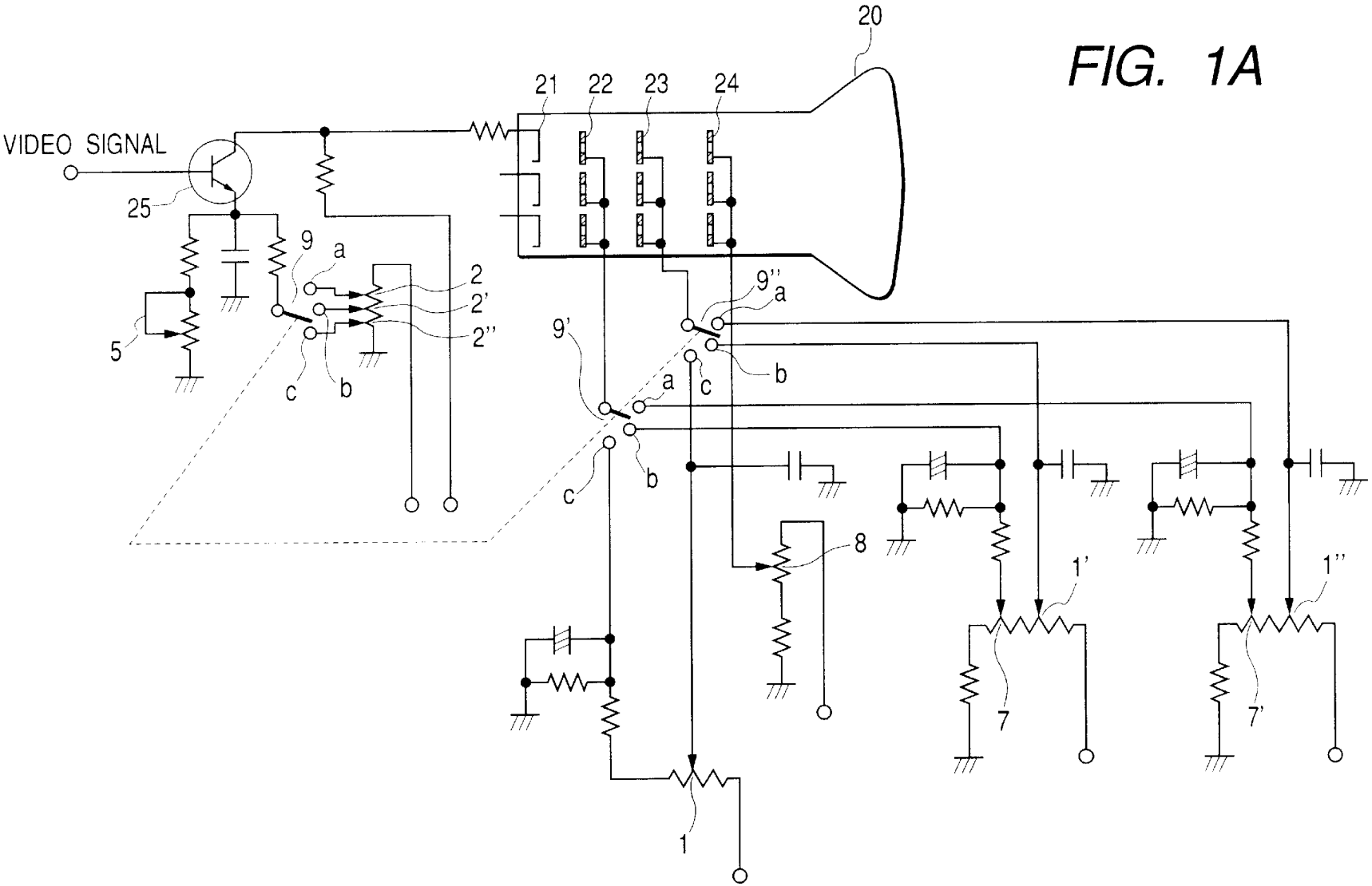
FIG. 1A is a circuit diagram for explaining a first embodiment of a circuit for driving a color cathode ray tube in accordance with the present invention.
Figure 17:
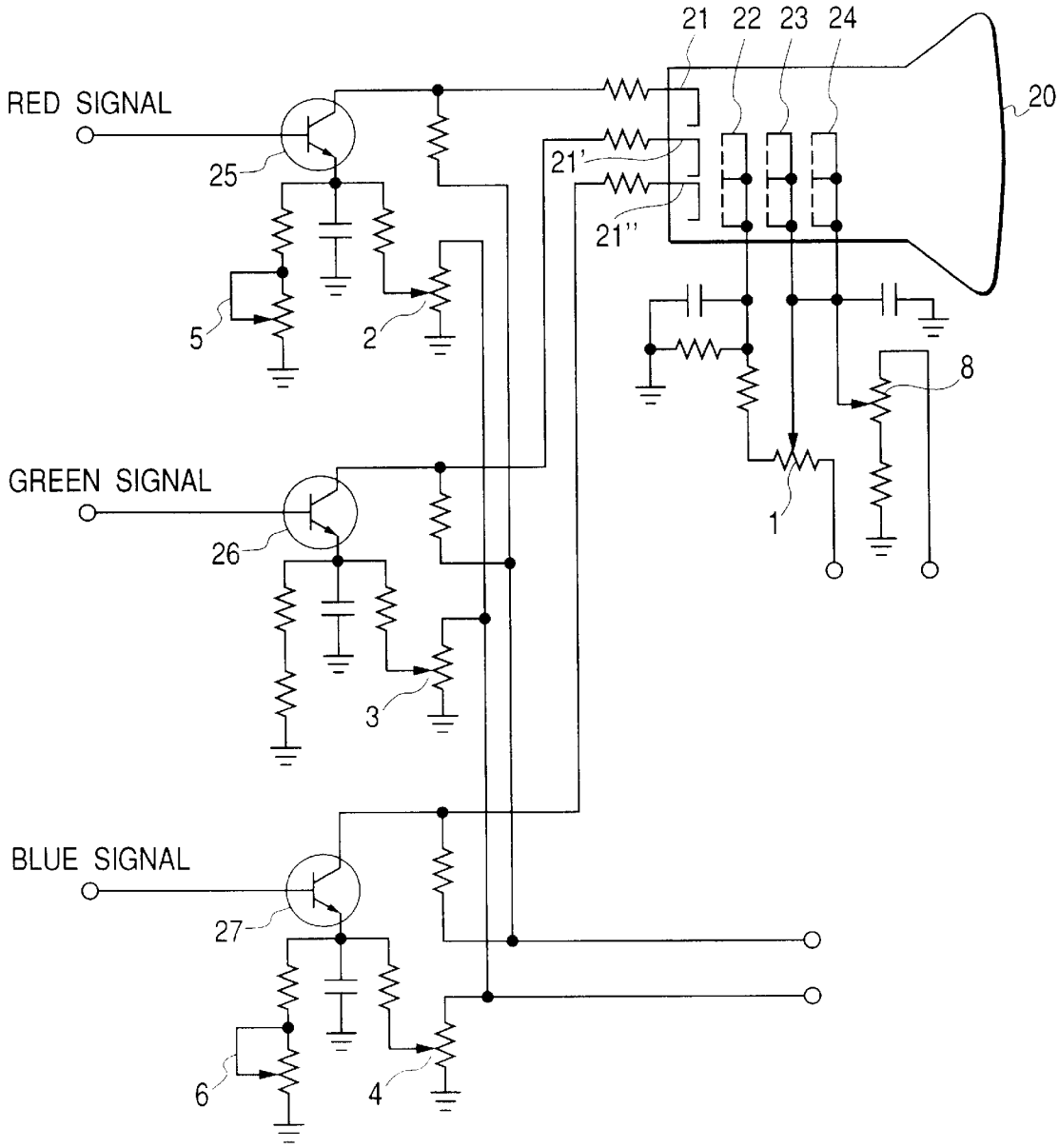
FIG. 17 PRIOR ART
FIG. 17 is an illustration of examples of a conventional color cathode ray tube and a conventional driving circuit for diving the color cathode ray tube used in conventional color TV receivers or conventional display monitors of information terminals.

FIG. 1A is a circuit diagram for explaining a first embodiment of a circuit for driving a color cathode ray tube in accordance with the present invention. The same reference numerals as utilized in FIG. 17 designate corresponding or functionally similar portions in FIG. 1A, and functionally identical portions in FIG. 1A and the succeeding drawings are identified with the same reference numerals with or without an added notation (') or (").

In the circuit configuration of FIG. 1A, three combinations of voltages applied on cathodes and electrodes are employed, but more than three combinations of the applied voltages can be employed. The following explains only one electron gun in the three-electron-beam in-line type electron gun, and the following explanation is also applicable to the other two electron guns.

In FIG. 1A, three voltages to be applied on the second grid electrode 23 are selected to be three desired values in advance by using three variable resistors 1, 1', 1" for adjusting the second grid electrode voltage, and three voltages to be applied on the first grid electrode 22 are selected to be three desired values in advance by using two variable resistors 7, 7' for adjusting the first grid electrode voltage. An output transistor 25 is provided with variable resistors 2, 2', 2" for adjusting its emitter voltage. The switching between the variable resistors 1, 1', 1", between the variable resistors 7, 7', and between the variable resistors 2, 2', 2" is performed by mutually interlocking switches 9, 9', 9" according to desired performance characteristics of the color cathode ray tube.

With this configuration, a cathode 21 can be provided with a bias voltage most suitable for desired performance characteristics, and thereby an image display can be obtained which is most suitable for characteristics of input signals.

Figure 2:
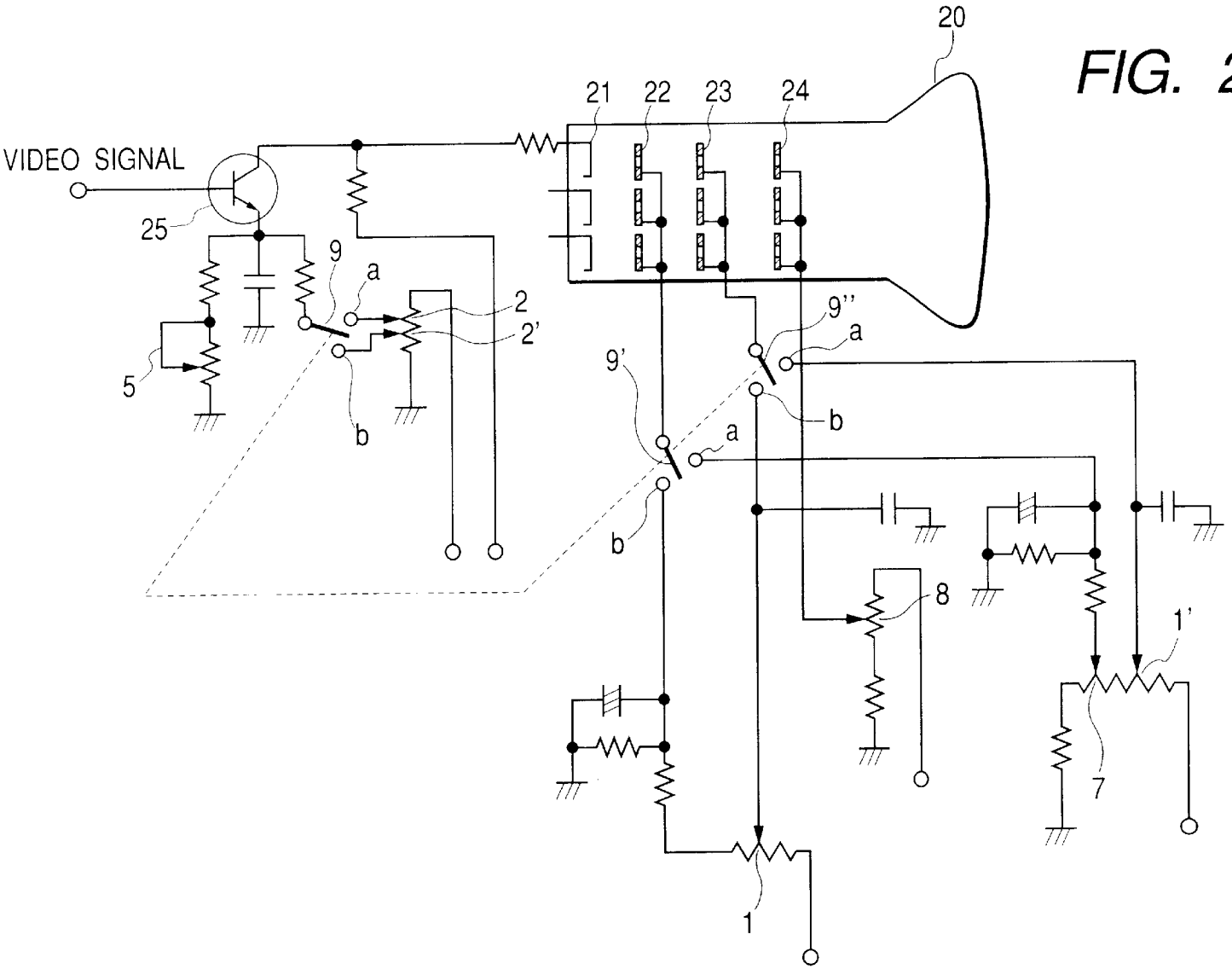
FIG. 2 is a circuit diagram for explaining a second embodiment of a circuit for driving a color cathode ray tube in accordance with the present invention.

FIG. 2 is a circuit diagram for explaining a second embodiment of a circuit for driving a color cathode ray tube in accordance with the present invention. In the circuit configuration of FIG. 2, two combinations of voltages applied on cathodes and electrodes are employed, but more than two combinations of the applied voltages can be employed. The same reference numerals as utilized in FIG. 1A designate corresponding or functionally similar portions in FIG. 2. The following explains only one electron gun in the three-beam in-line type electron gun, and the following explanation is also applicable to the other two electron guns.

In FIG. 2, two voltages to be applied on the second grid electrode 23 are selected to be two desired values in advance by using two variable resistors 1, 1' for adjusting the second grid electrode voltage, and two voltages to be applied on the first grid electrode 22 are selected to be two desired values in advance by using a variable resistor 7 for adjusting the first grid electrode voltage. An output transistor 25 is provided with variable resistors 2, 2' for adjusting its emitter voltage. The switching between the variable resistors 1, 1', between nonuse and use of the variable resistor 7, and between the variable resistors 2, 2' is performed by mutually interlocking switches 9, 9', 9" according to desired performance characteristics of the color cathode ray tube.

With this configuration, a cathode 21 can be provided with a bias voltage most suitable for desired performance characteristics, and thereby an image display can be obtained which is most suitable for characteristics of input signals.

Figure 3:
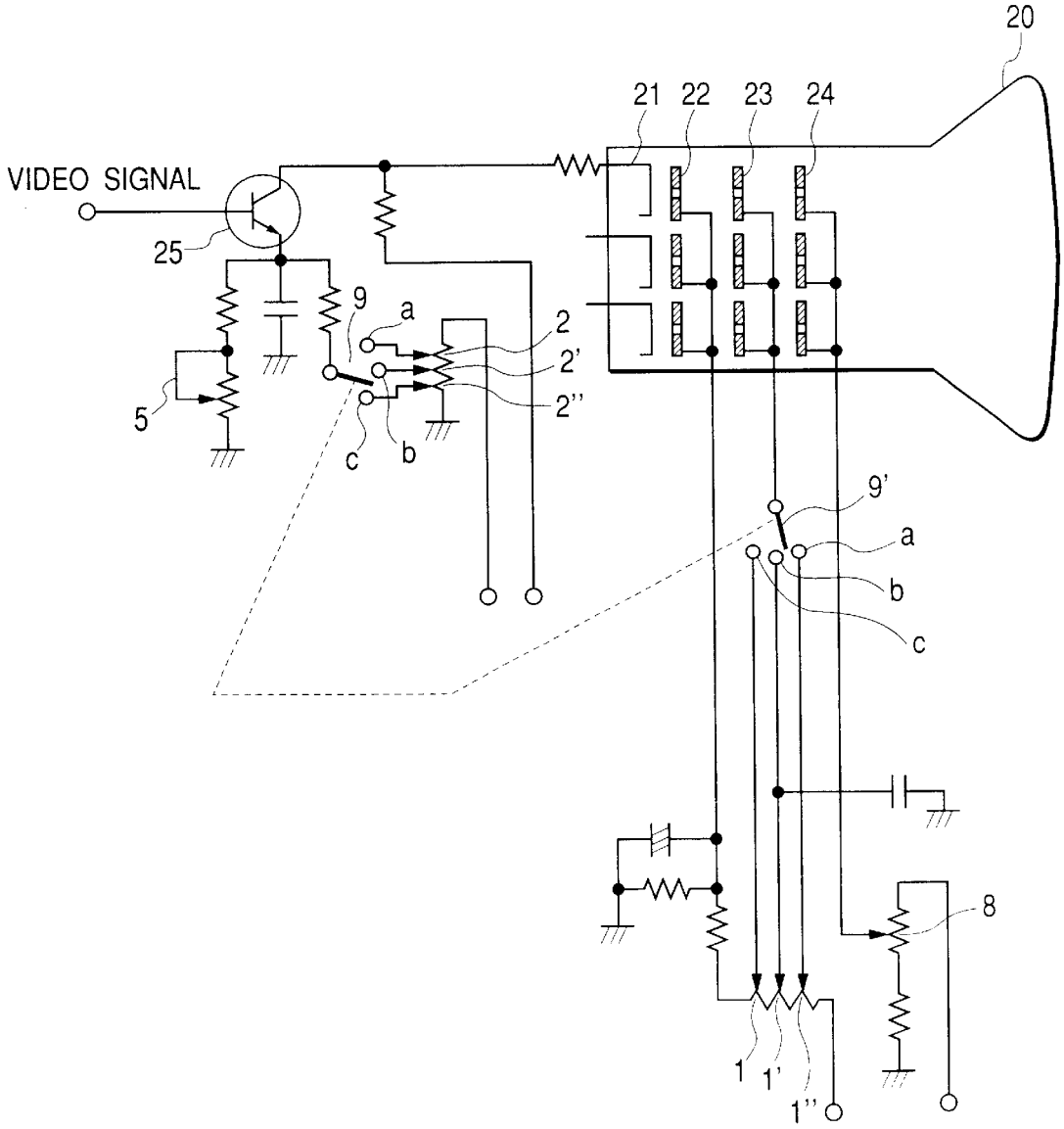
FIG. 3 is a circuit diagram for explaining a third embodiment of a circuit for driving a color cathode ray tube in accordance with the present invention.

FIG. 3 is a circuit diagram for explaining a third embodiment of a circuit for driving a color cathode ray tube in accordance with the present invention. The same reference numerals as utilized in FIG. 1A designate corresponding or functionally similar portions in FIG. 3.

In the circuit configuration of FIG. 3, three combinations of voltages applied on cathodes and electrodes are employed but more than three combinations of the applied voltages can be employed.

The following explains only one electron gun in the three-electron-beam in-line type electron gun, and the following explanation is also applicable to the other two electron guns.

In FIG. 3, a voltage applied on the first grid electrode 22 is fixed at all times, but three voltages to be applied on the second grid electrode 23 are selected to be three desired values in advance by using three variable resistors 1, 1', 1" for adjusting the second grid electrode voltage, and a voltage applied on the third grid electrode 24 are selected to be a desired value in advance by a variable resistor 8 for adjusting the third grid electrode voltage. An output transistor 25 is provided with variable resistors 2, 2', 2" for adjusting its emitter voltage. The switching between the variable resistors 1, 1', 1", and between the variable resistors 2, 2', 2" is performed by mutually interlocking switches 9, 9' according to desired performance characteristics of the color cathode ray tube.

With this configuration, a cathode 21 can be provided with a bias voltage most suitable for desired performance characteristics, and thereby an image display can be obtained which is most suitable for characteristics of input signals.

Figure 4:
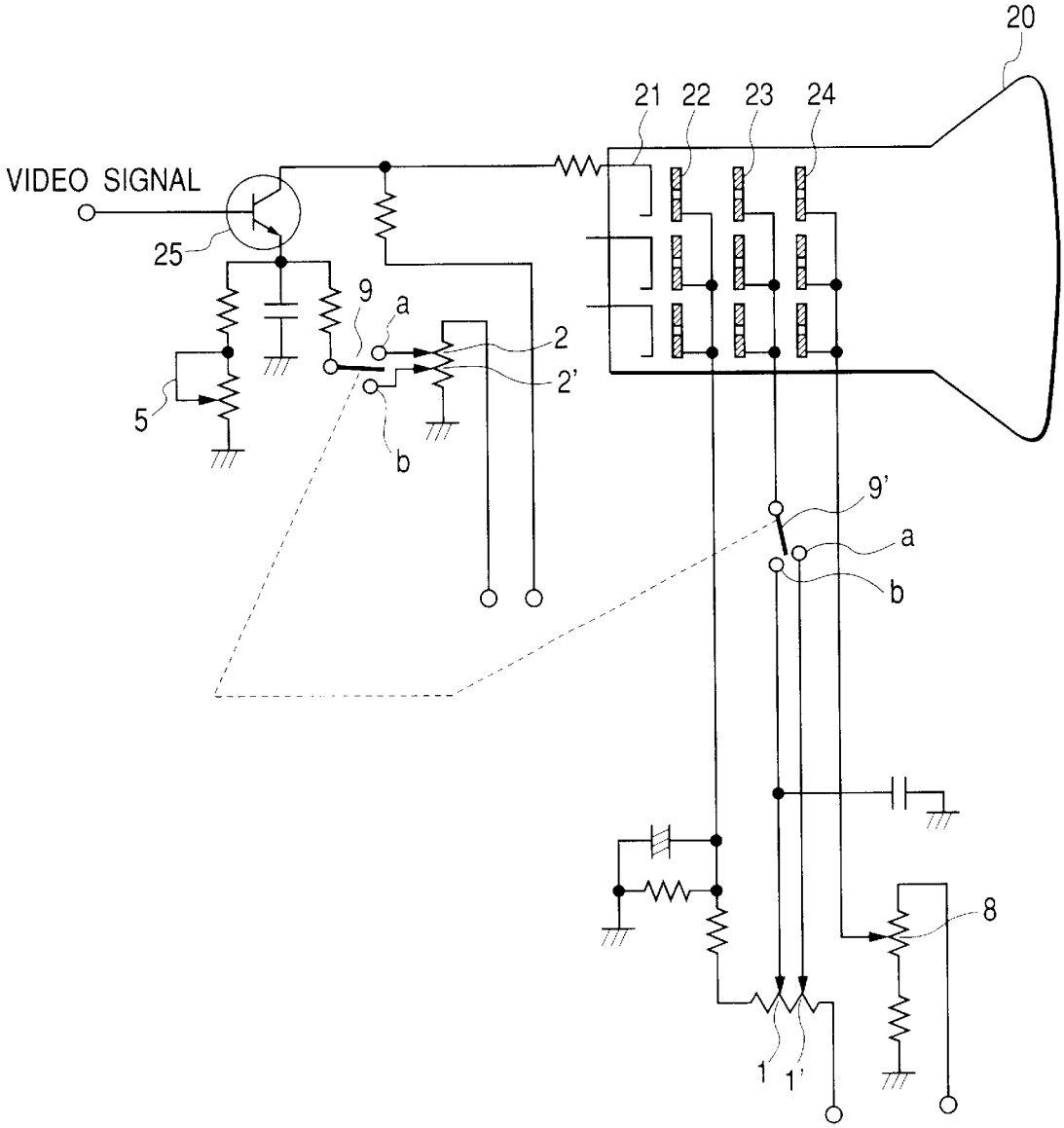
FIG. 4 is a circuit diagram for explaining a fourth embodiment of a circuit for driving a color cathode ray tube in accordance with the present invention.

FIG. 4 is a circuit diagram for explaining a fourth embodiment of a circuit for driving a color cathode ray tube in accordance with the present invention. In the circuit configuration of FIG. 4, two combinations of voltages applied on cathodes and electrodes are employed, but more than two combinations of the applied voltages can be employed.

The same reference numerals as utilized in FIG. 1A designate corresponding or functionally similar portions in FIG. 4. The following explains only one electron gun in the three-electron-beam in-line type electron gun, and the following explanation is also applicable to the other two electron guns.

In FIG. 4, two voltages to be applied on the second grid electrode 23 are selected to be two desired values in advance by using two variable resistors 1, 1' for adjusting the second grid electrode voltage, and a voltage applied on the first grid electrode 22 is fixed at all times. A voltage applied on the third grid electrode 24 are selected to be a desired value in advance by a variable resistor 8 for adjusting the third grid electrode voltage. An output transistor 25 is provided with variable resistors 2, 2' for adjusting its emitter voltage. The switching between the variable resistors 1, 1', and between the variable resistors 2, 2' is performed by mutually interlocking switches 9, 9' according to desired performance characteristics of the color cathode ray tube.

With this configuration, a cathode 21 can be provided with a bias voltage most suitable for desired performance characteristics, and thereby an image display can be obtained which is most suitable for characteristics of input signals.

TABLE 1

| | High-frequency Mode Operation | Low-frequency Mode Operation |
|---|---|---|
| Horiz. Def. Freq. | ≧48 kHz | ≦31.5 kHz |
| Ec2 - Ec1 | 600 V | 390 V |
| Cathode Bias Voltage - Ec1 | 110 V | 75 V |

Table 1 shows an example of two combinations of the applied voltages corresponding to high-frequency and low-frequency mode operations, respectively, applied to the embodiment explained in connection with FIG. 4. For the high-frequency mode operation in which the horizontal deflection frequency≧48 kHz, the switch positions a of the switches 9 and 9' are set such that the voltage difference between the second grid electrode voltage Ec2 and the first grid electrode voltage Ec1 is 600 V, and the voltage difference between the cathode bias voltage and the first grid electrode voltage Ec2 is 110 V. For the low-frequency mode operation in which the horizontal deflection frequency≦31.5 kHz, the switch positions b of the switches 9 and 9' are set such that the voltage difference between the second grid electrode voltage Ec2 and the first grid electrode voltage Ec1 is 390 V, and the voltage difference between the cathode bias voltage and the first grid electrode voltage Ec2 is 75 V.

In the embodiments shown in FIGS. 1 to 4, the switches 9, 9' and 9" can be ones automatically operated by identifying incoming video signals, or manual switches. The automatic switches can be realized which are provided with a conventional circuit for identifying the kind of incoming video signals and are configured to perform electronic switching by using signals from the identifying circuit.

Figure 1B:
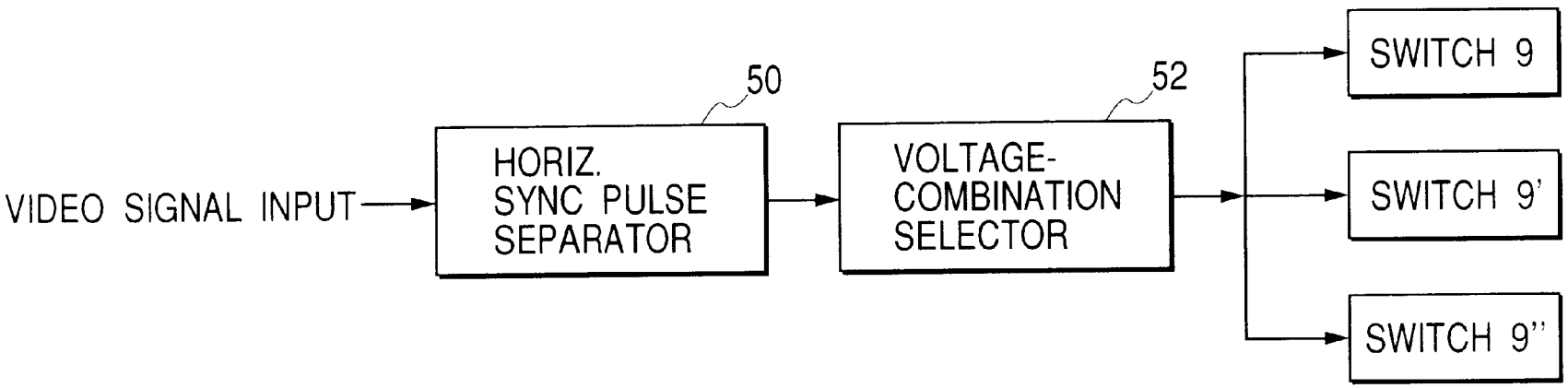
FIG. 1B is a block diagram for explaining automatic switching between plural combinations of applied voltages in accordance with an embodiment of the present invention.

For example, as shown in FIG. 1B, horizontal sync pulses are separated from incoming video signals by a horizontal sync pulse separator 50, and are supplied to a voltage-combination selector 52. The voltage-combination selector 52 selects one of a plurality of combinations of voltages to be applied on the cathodes and the electrodes intended for the frequency of the separated horizontal sync signals, and supplies a switch operating signal to the switches 9, 9' and 9" such that each of the switches 9, 9' and 9" selects a corresponding one of switch positions a, b, c indicated in FIG. 1A.

Figure 18:
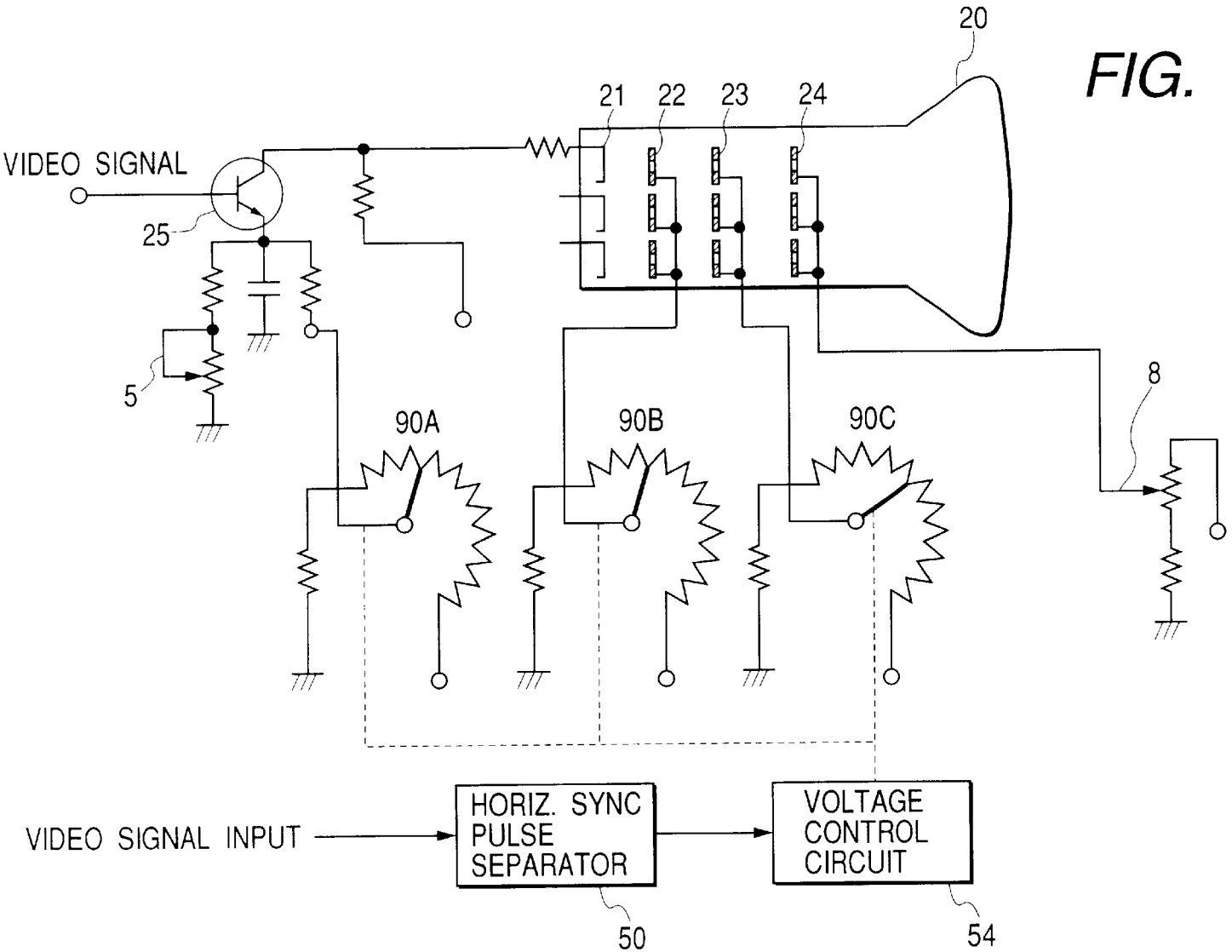
FIG. 18 is a circuit diagram for explaining another embodiment of a circuit for driving a color cathode ray tube in accordance with the present invention.

The above embodiments are configured such that the voltages applied on the cathodes and the electrodes of the electron gun vary in discrete steps, but those voltages can be made to vary continuously. For example, as shown in FIG. 18, the continuously adjustable resistors 90A, 90B and 90C are employed and controlled by a voltage control circuit 54 based upon the frequency of the separated horizontal sync signals supplied by the horizontal sync pulse separator 50 as in the case of the embodiment explained in connection with FIG. 1B. In this embodiment also, the voltage difference between the second grid electrode voltage and the first grid electrode voltage increases when the horizontal deflection frequency of the three electron beams is increased.

The following explains a color cathode ray tube in accordance with another embodiment of the present invention, which has optimized an electrode configuration of its electron gun, and thereby is capable of being used for both a display such as a monitor display of a computer and a television receiver.

Figure 5:
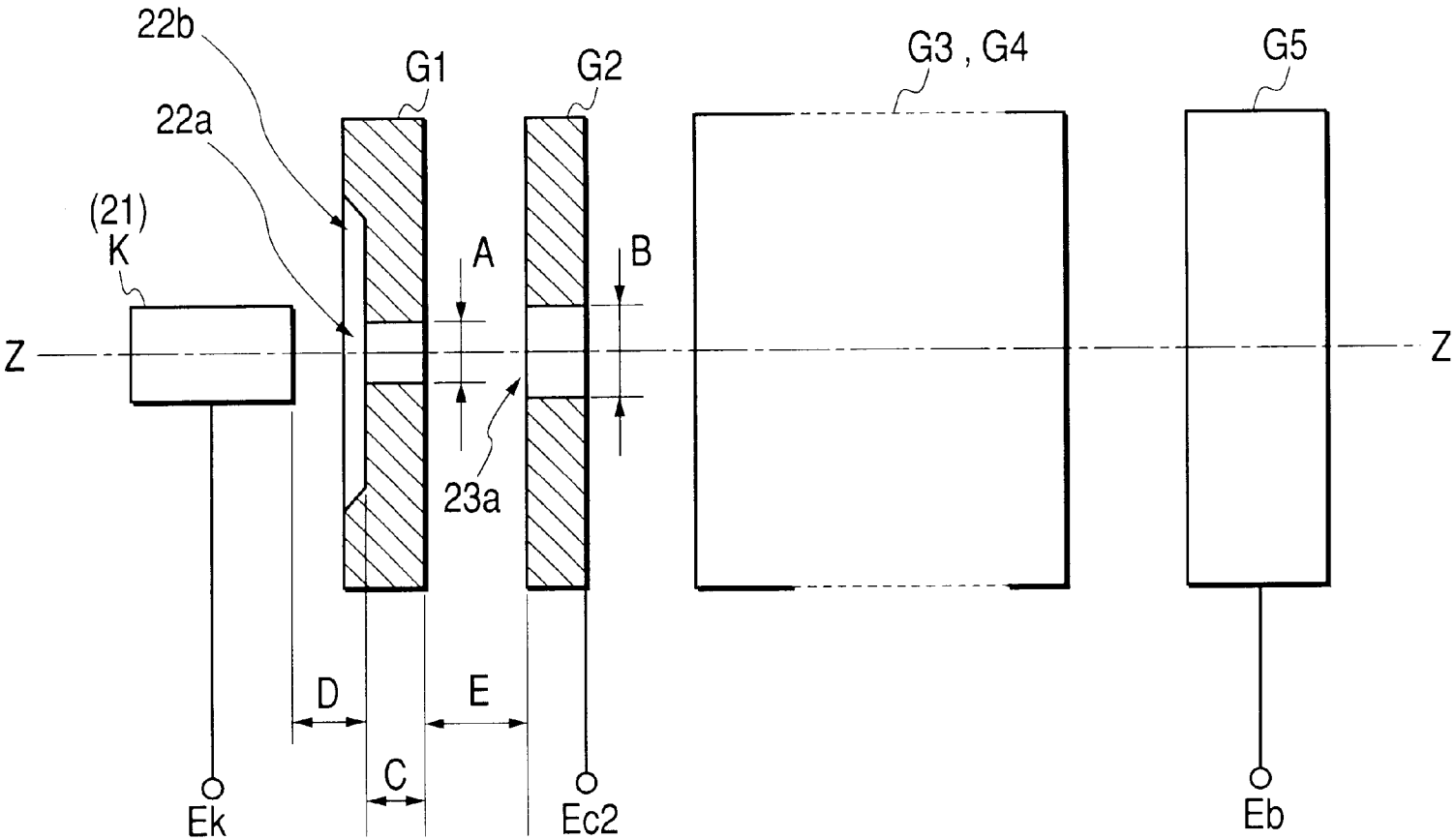
FIG. 5 is a schematic illustration of an example of a configuration of an electron gun employed in a color cathode ray tube in accordance with the present invention.

FIG. 5 is a schematic illustration of an example of a configuration of an electron gun employed in a color cathode ray tube in accordance with the present invention. Reference character K denotes a cathode (which is designated as 21 in the previous figures), G1 is the first grid electrode (22 in the previous figures), G2 is the second grid electrode (23 in the previous figures), G3 is the third grid electrode (24 in the previous figures), G4 is the fourth grid electrode, and G5 is the fifth grid electrode. The cathode K and the electrodes G1 to G5 are arranged on the tube axis Z—Z in the specified order with specified spacings therebetween.

Incidentally, the electrode configuration shown in FIG. 5 is only one example, and various configurations of the fourth grid electrode and electrodes succeeding it are known, and the present embodiment is also applicable to electron guns employing the electrode configurations other than that shown in FIG. 5.

In FIG. 5, a recess 22*b* is formed around a periphery of an electron-beam transmissive aperture 22*a* on a cathode-K-side surface of the first grid electrode G1 by thinning the thickness of the first grid electrode G1 using a so-called coining process (a cold metalworking process). The recess 22*b* may be hereinafter called the coined portion.

Symbol D represents a spacing between the cathode K and the electron-beam transmissive aperture 22*a* in the first grid electrode G1, C is the thickness of a portion of the G1 electrode immediately surrounding the electron-beam transmissive aperture 22*a,* A is a diameter of the electron-beam transmissive aperture 22*a,* E is a spacing between the electron-beam transmissive aperture 23*a* in the second grid electrode G2 and the first grid electrode G1, and B is a diameter of the electron-beam transmissive aperture 23*a*. The cathode K, the first grid electrode G1 and the second grid electrode G2 form a so-called triode section.

In the present embodiment, a color image reproducing device is capable of switching between a plurality of combinations of a voltage Ec1 to be applied on the first grid electrode G1, a voltage Ec2 to be applied on the second grid electrode G2, and a bias voltage Ekbias to be applied on the cathode K, and is also capable of electronically switching between plural voltages Ec2 to be applied on the second grid electrode G2, and between plural bias voltages Ekbias to be applied on the cathode K with the voltage Ec1 applied on the first grid electrode being fixed.

In FIG. 5, the following inequalities are satisfied:

$$E \leqq 1.4A - 0.2B - 2.7C - 2D,$$

$$A \leqq 0.35\ mm,$$

where

A (mm) is the diameter of the electron-beam transmissive aperture 22*a* in the first grid electrode G1, B (mm) is the diameter of the electron-beam transmissive aperture 23*a* in the second grid electrode G2, C (mm) is the thickness of a portion of the first grid electrode immediately surrounding the electron-beam transmissive aperture 22*a* in the first grid electrode G1, D (mm) is a spacing between the cathode K and the electron-beam transmissive aperture 22*a* in the first grid electrode G1, and E (mm) is a spacing between the first grid electrode G1 and the second grid electrode G2.

When the electron-beam transmissive apertures 22*a,* 23*a* are not circular, but are non-axially-symmetric as in the case of being rectangular, square or elliptical, the diameters A, B are defined as the diameters of circles having areas equal to those of the non-axially-symmetric apertures 22*a,* 23*a*.

In this embodiment, a display mode by using the optimum combination of voltages to be applied on the cathode and the grid electrodes is easily set by an electronic control using power transistors. In the embodiments explained in connection with FIGS. 1 to 4, one of the plural combinations of the applied voltages is selected according to incoming video signals, and electronic switching between the plural combinations of the applied voltages is facilitated by employment of an electron gun having the configuration of the triode section shown in FIG. 5. Consequently, a color image reproducing device can be provided which is capable of being used for both a display such as a monitor display of a computer and a television receiver.

In order to electronically control the voltages Ec2 applied on the second grid electrode G2, it is necessary that the maximum of the voltages Ec2 is not greater than the maximum bias voltage rating of the above-mentioned power transistor. The maximum withstand voltage of power transistors is about 400 volts according to catalogues of current semiconductor manufacturers.

Figure 6:
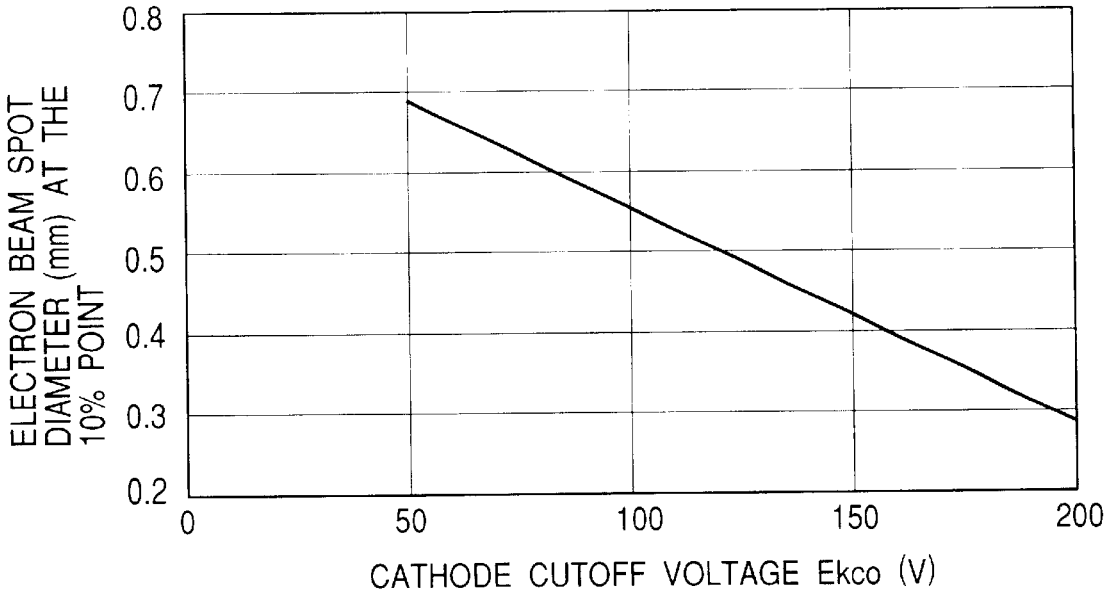
FIG. 6 is a graph showing a relationship between cathode cutoff voltages Ekco and electron beam spot diameters (mm) at the 10% intensity profile at a cathode current of 0.3 mA.

FIG. 6 is a graph showing a relationship between cathode cutoff voltages Ekco and electron beam spot diameters (mm) at the 10% intensity profile at a cathode current of 0.3 mA, obtained by computer simulation in which the lengths of the second and fourth grid electrodes were optimized for each of cathode cutoff voltages Ekco in multistage dynamic-focus type electron guns having an extended-diameter main lens and used for a display-use cathode ray tube (CDT) of 51 cm in useful diagonal screen dimension.

The simulation conditions are as follows:

the electron-beam transmissive aperture A in the first grid electrode=0.35 mm, the electron-beam transmissive aperture B in the second grid electrode=0.35 mm, the thickness C of the portion immediately surrounding the electron-beam transmissive aperture A=0.1 mm, the spacing D between the cathode and the portion immediately surrounding the electron-beam transmissive aperture A=0.05 mm, and the spacing E between the first and second grid electrodes=0.05 mm.

In a display-use cathode ray tube (CDT) of 51 cm in useful diagonal screen dimension, the brightness of a white raster is set at 100 cd/mm$^2$ in the standard conditions of operation, the average of the cathode currents corresponding to this brightness is about 0.3 mA, and therefore this current value was adopted for the simulation.

In FIG. 6, the minimum electron-beam spot diameter is determined by cathode loading (the current density of the cathode) and aberration of the main lens. If the aberration in the main lens is assumed to be fixed when the lengths of the electrodes are optimized, the electron-beam spot diameter is determined by the cathode loading only.

The smaller the diameter of the electron-beam transmissive aperture in the first grid electrode G1 and the greater the cathode cutoff voltage Ekco, the higher the cathode loading.

In the standard specification for the above-described electron guns used for the current 51 cm-diagonal display-use cathode ray tubes (CDT), the diameter A of the electron-beam transmissive aperture in the first grid electrode G1 and the cathode cutoff voltage Ekco are 0.35 mm and 110 V, respectively. Consequently, to retain focus characteristics of the current 51 cm-diagonal display-use cathode ray tubes (CDT) and electronically control the cathode bias voltage and the first and second grid electrode voltages, it is necessary that the diameter A of the electron-beam transmissive aperture in the first grid electrode G1 is equal to or less than 0.35 mm, the voltage Ec2 applied on the second grid electrode G2$\leqq$400 V, and the cathode cutoff voltage Ekco$\geqq$110 V.

Figure 7:
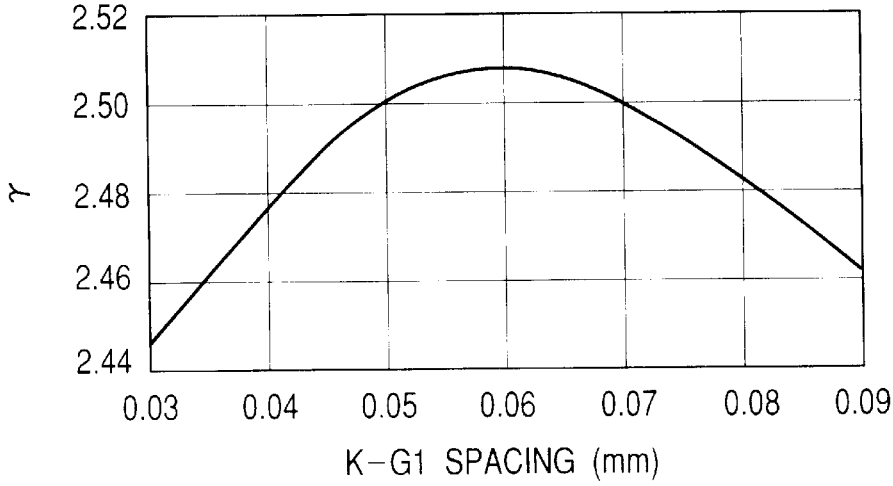
FIG. 7 is a graph showing a relationship between spacings D (mm) between the cathode K and the first grid electrode G1 and $\gamma$ which is the slope of cathode current versus drive voltage curves plotted in a log-log graph.

FIG. 7 is a graph showing a relationship between spacings D (mm) between the cathode K and the first grid electrode G1 and $\gamma$ which is the slope of cathode current versus drive voltage curves plotted in a log-log graph, obtained by computer simulation in which the diameter A (mm) of the electron-beam transmissive aperture in the first grid electrode G1 was 0.35 mm, and the cathode cutoff voltage Ekco was fixed at 110 V.

As is apparent from FIG. 7, $\gamma$ becomes maximum in the vicinity of 0.05 mm to 0.07 mm of the spacings D (mm) between the cathode K and the first grid electrode G1.

Figure 8:
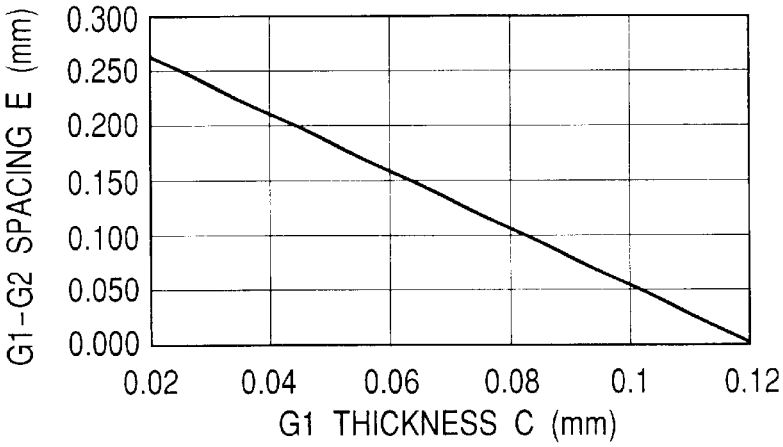
FIG. 8 is a graph showing a relationship between the spacings E (mm) between the first grid electrode G1 and the second grid electrode G2 and the thicknesses (mm) of the portion of the first grid electrode G1 immediately surrounding its electron-beam transmissive aperture with the cathode cutoff voltage fixed at 110 V.

FIG. 8 is a graph showing a relationship between the spacings E (mm) between the first grid electrode G1 and the second grid electrode G2 and the thicknesses (mm) of the portion of the first grid electrode G1 immediately surrounding its electron-beam transmissive aperture, obtained by computer simulation in which the diameters A, B of the electron-beam transmissive apertures in the first and second grid electrodes G1, G2 were 0.35 mm, the spacing between the cathode K and the first grid electrode G1 was 0.05 mm, the voltage applied on the second grid electrode G2 was 400 V, and the cathode cutoff voltage was fixed at 110 V.

Figure 9:
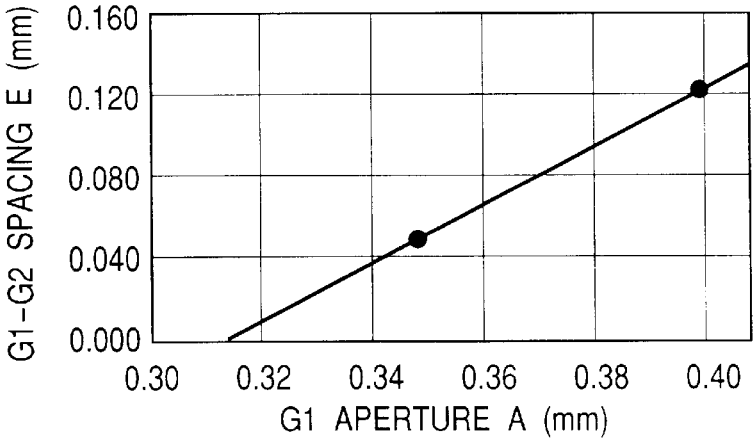
FIG. 9 is a graph showing a relationship between the spacings E and the diameters (mm) of the electron-beam transmissive aperture in the first grid electrode G1 with the cathode cutoff voltage fixed at 110 V.

FIG. 9 is a graph showing a relationship between the spacings E (mm) between the first grid electrode G1 and the second grid electrode G2 and the diameters (mm) of the electron-beam transmissive aperture in the first grid electrode G1, obtained by computer simulation in which the diameter B (mm) of the electron-beam transmissive aperture in the second grid electrode G2 was 0.35 mm, the spacing between the cathode K and the first grid electrode G1 was 0.05 mm, the thickness of the portion of the first grid electrode G1 immediately surrounding its electron-beam transmissive aperture was 0.1 mm, the voltage applied on the second grid electrode G2 was 400 V, and the cathode cutoff voltage was fixed at 110 V.

Figure 10:
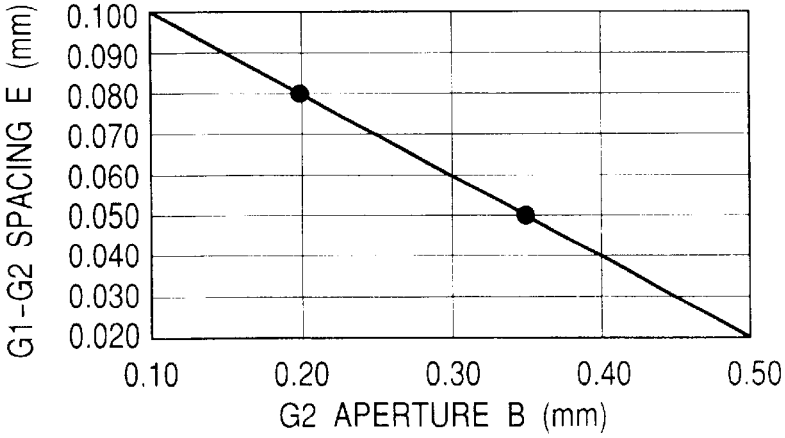
FIG. 10 is a graph showing a relationship between the spacings E (mm) between the first grid electrode G1 and the second grid electrode G2 and the diameters (mm) of the electron-beam transmissive aperture in the second grid electrode G2 with the cathode cutoff voltage fixed at 110 V.

FIG. 10 is a graph showing a relationship between the spacings E (mm) between the first grid electrode G1 and the second grid electrode G2 and the diameters (mm) of the electron-beam transmissive aperture in the second grid electrode G2, obtained by computer simulation in which the diameter A (mm) of the electron-beam transmissive aperture in the first grid electrode G1 was 0.35 mm, the spacing between the cathode K and the first grid electrode G1 was 0.05 mm, the thickness of the portion of the first grid electrode G1 immediately surrounding its electron-beam transmissive aperture was 0.1 mm, the voltage applied on the second grid electrode G2 was 400 V, and the cathode cutoff voltage was fixed at 110 V. The cathode loading is determined by the area of the electron-beam transmissive aperture in the first grid electrode G1, and therefore if the electron-beam transmissive aperture is not circular, but are non-axially-symmetric as in the case of being rectangular, square or elliptical, an equivalent diameter of the electron-beam transmissive aperture is used which is obtained by calculating a diameter of a circle having an area equal to that of the non-axially-symmetric aperture.

In FIG. 8, the slope of the plot of the spacings E (mm) between the first and second grid electrodes G1, G2 versus the thicknesses C (mm) of the portion of the first grid electrode G1 (22) immediately surrounding its electron-beam transmissive aperture is −2.7, in FIG. 9, the slope of the plot of the spacings E (mm) between the first and second grid electrodes G1, G2 versus the diameters A (mm) of the electron-beam transmissive aperture in the first grid electrode G1 is 1.4, and in FIG. 10, the slope of the plot of the spacings E (mm) between the first and second grid electrodes G1, G2 versus the diameters B (mm) of the electron-beam transmissive aperture in the second grid electrode G2 is −0.2.

The spacing D (mm) between the cathode K and the portion of the first grid electrode G1 immediately surrounding its electron-beam transmissive aperture is twice as influential on cathode cutoff voltages Ekco as the spacing E (mm) between the first and second grid electrodes G1, G2. In order to obtain the same magnitude of the cutoff voltage Ekco with the lower magnitude of the voltage Ec2 applied on the second grid electrode G2, it is necessary to reduce both the spacing D (mm) between the cathode K and the portion of the first grid electrode G1 immediately surrounding its electron-beam transmissive aperture and the spacing E (mm) between the first and second grid electrodes G1, G2.

Consequently, if the following inequalities are satisfied, the voltage Ec2 applied on the second grid electrode G2 is capable of being electronically controlled and retaining the focus characteristics of the current display-use cathode ray tubes (CDT):

$$E(mm) \leqq 1.4A(mm) - 0.2B(mm) - 2.7C(mm) - 2.0D(mm),$$

$$A\ (mm) \leqq 0.35(mm).$$

Table 2 shows an example of two combinations of the applied voltages corresponding to high-frequency and low-frequency mode operations, respectively, applied to the embodiment explained in connection with FIG. 5. For the high-frequency mode operation in which the horizontal deflection frequency≧48 kHz, the voltage difference between the second grid electrode voltage Ec2 and the first grid electrode voltage Ec1 is selected to be 400 V, and the voltage difference between the cathode bias voltage and the first grid electrode voltage Ec2 is 110 V. For the low-frequency mode operation in which the horizontal deflection frequency≦31.5 kHz, the voltage difference between the second grid electrode voltage Ec2 and the first grid electrode voltage Ec1 is selected to be 260 V, and the voltage difference between the cathode bias voltage and the first grid electrode voltage Ec2 is 75 V.

TABLE 2

| | High-frequency Mode Operation | Low-frequency Mode Operation |
|---|---|---|
| Horiz. Def. Freq. | ≧48 kHz | ≦31.5 kHz |
| Ec2 - Ec1 | 400 V | 260 V |
| Cathode Bias Voltage - Ec1 | 110 V | 75 V |

The present embodiment provides a color cathode ray tube capable of producing a high-definition display required of the display monitors of information terminals and a high-brightness and high-contrast display required of the color television receiver.

Figure 11:
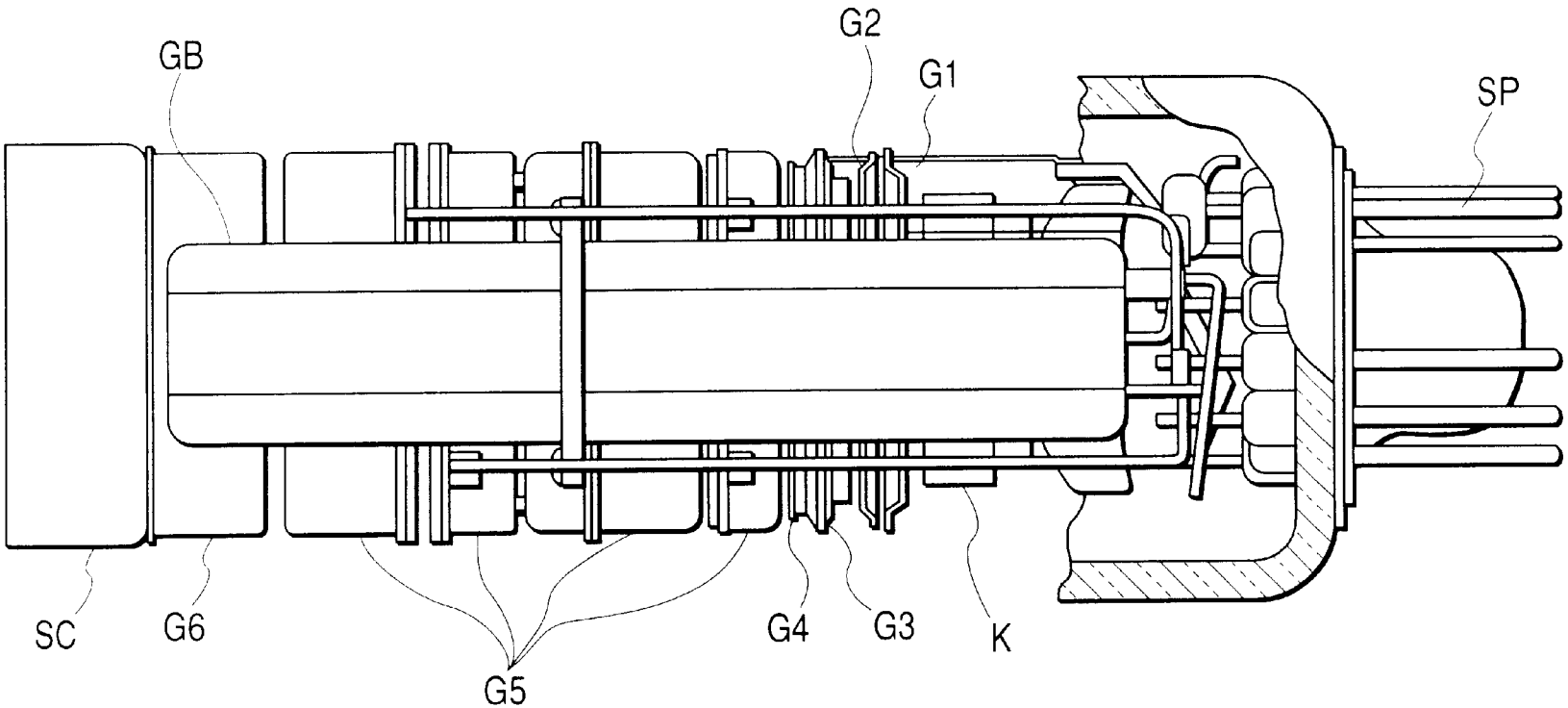
FIG. 11 is a side view of an example of an electron gun used in the color cathode ray tube in accordance with the present invention.

FIG. 11 is a side view of an example of an electron gun used in the color cathode ray tube in accordance with the present invention. This electron gun comprises three cathodes K for emitting three in-line electron beams, the first grid electrode G1, the second grid electrode G2, the third grid electrode G3, the fourth grid electrode G4, the fifth grid electrode G5, and the sixth grid electrode G6 fixed with the above-specified spacings therebetween on a pair of bead glasses GB. Reference character SC denotes a shield cup welded to the front end (the phosphor screen side end) of the sixth grid electrode G6, and reference character SP are stem pins for supplying video signals and electrode voltages.

The present invention is not limited to the electron gun having the electrode configuration shown in FIG. 11, but is also applicable to electron guns having other conventional electrode configurations.

Figure 12:
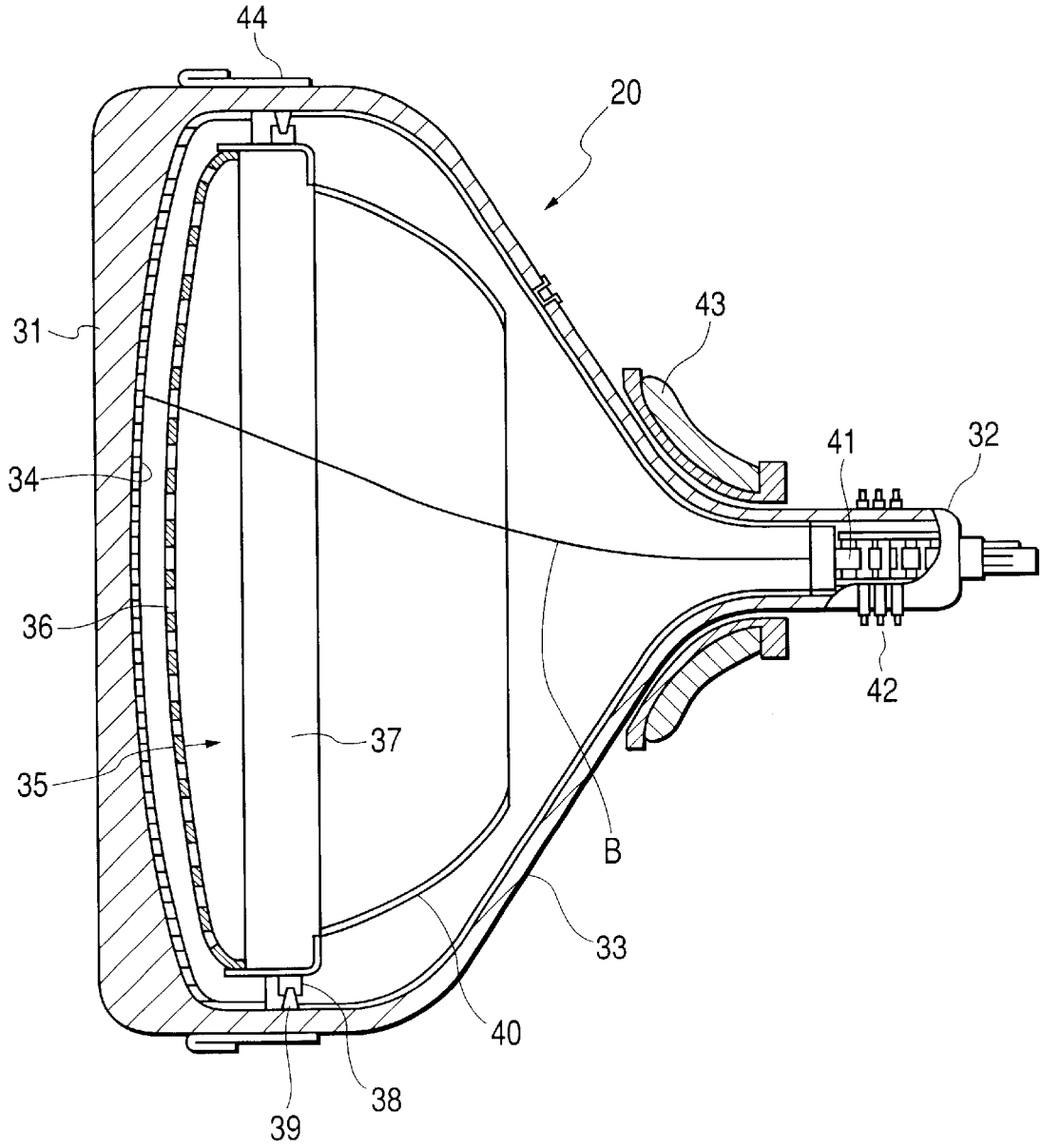
FIG. 12 is a schematic cross-sectional view of an example of a structure of a shadow mask type color cathode ray tube in accordance with an embodiment of the present invention.

FIG. 12 is a schematic cross-sectional view of an example of a structure of a shadow mask type color cathode ray tube in accordance with an embodiment of the present invention. In the color cathode ray tube 20, a vacuum envelope is comprised of a panel 31, a neck 32 and a funnel 33. A phosphor screen 34 formed by coating three-color phosphors is disposed on the inner surface of the panel 31. A shadow mask structure 35 has welded to a mask frame 37 a shadow mask 36 having a large number of electron-beam transmissive apertures and is suspended on studs 39 embedded in the inner wall of the skirt portion of the panel 31 via suspension springs 38 such that the shadow mask 36 is closely spaced from the phosphor screen 34. A magnetic shield 40 is welded to an electron-gun-side end of the mask frame 37.

An electron gun 41 having the above-described electrode configuration is housed within the neck 32, and a deflection yoke 43 is mounted around the outside of the transition region between the funnel 33 and the neck 31 for scanning the three electron beams B (only one of which is shown) emitted from the electron gun 41 on the phosphor screen 34 in the two horizontal and vertical directions.

The color cathode ray tube shown in FIG. 12 is capable of producing a high-definition display required of the display monitors of information terminals and a high-brightness and high-contrast display required of the color television receiver.

Figure 13:
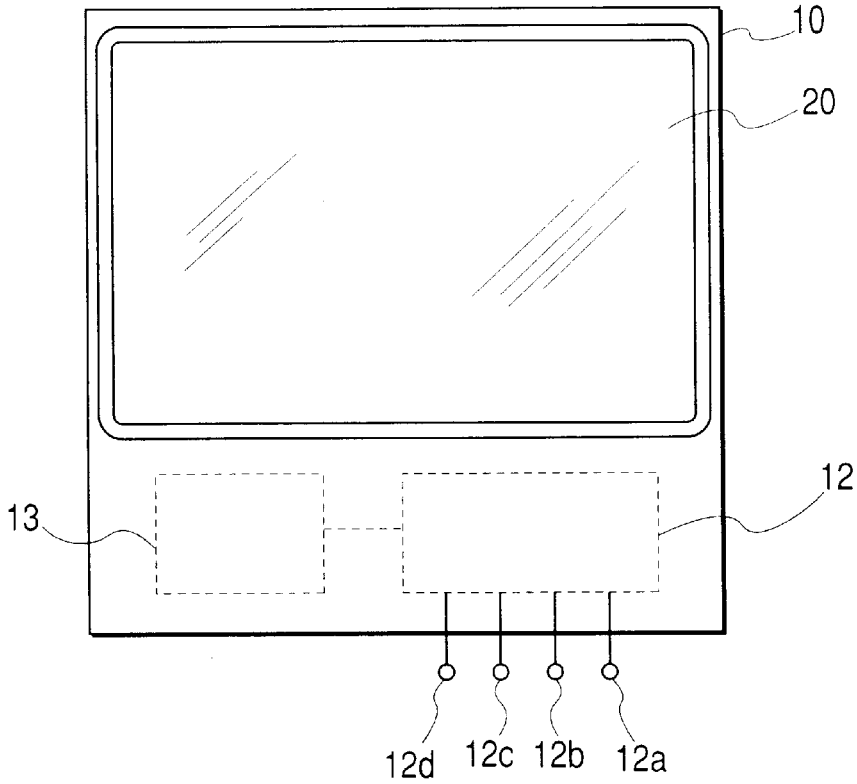
FIG. 13 is a schematic illustration of an example of a color image reproducing device in accordance with the present invention.

FIG. 13 is a schematic illustration of an example of a color image reproducing device in accordance with the present invention. In FIG. 13, reference numeral 10 denotes a color image reproducing device, 20 is a color cathode ray tube (an outer surface of a panel of which is shown), 12 is a driving circuit therefor explained in the previous embodiments, 12*a* is an input terminal for television signals, 12*b* is an input terminal for TV phone signals, 12*c* is an input terminal for signals from video tape recorders, 12*d* is an input terminal for signals from personal computers, and 13 is a horizontal and vertical deflection circuit. The color image reproducing device 10 is provided with the driving circuit 12 capable of switching between plural driving modes and the horizontal and vertical deflection circuit 13 for generating deflection signals corresponding to one of the plural driving modes selected by the driving circuit 12.

Consequently, the display of desired picture quality is obtained by performing the electronic or manual switching between driving modes according to the kind of video signals supplied to the driving circuit 12 for the color cathode ray tube via the input terminals 12*a* to 12*d*, by employing at least one of the embodiments explained in connection with FIGS. 1 to 10.

Figure 14:
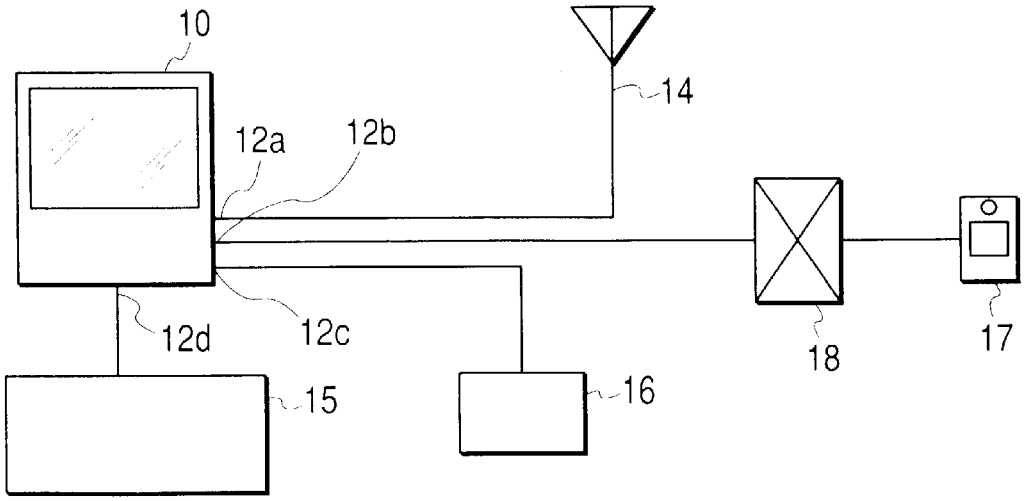
FIG. 14 is a schematic illustration of an example of a color image reproducing system in accordance with the present invention.
Figure 15:
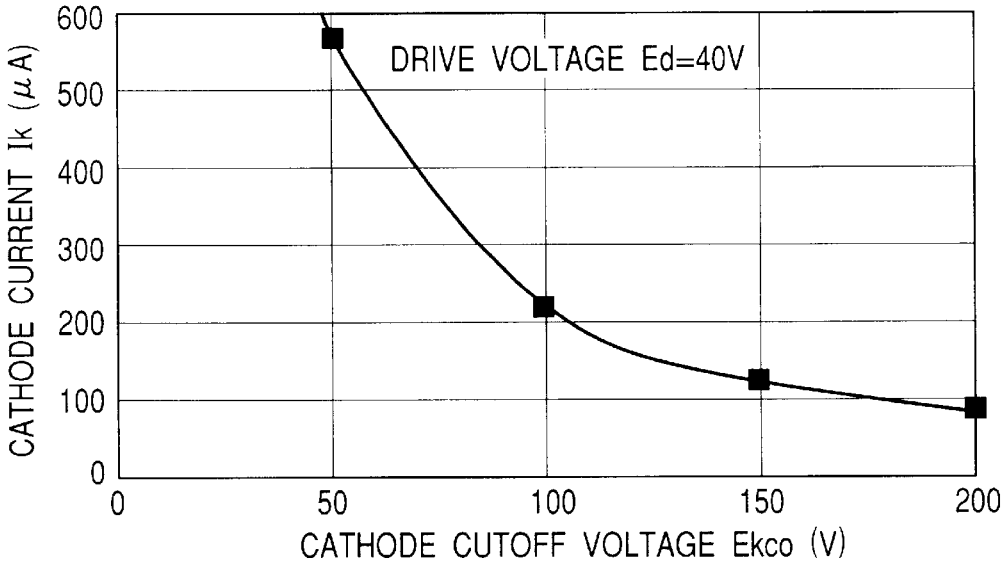
FIG. 15 is an illustration of an example of a relationship between cathode cutoff voltages and cathode currents with a fixed drive voltage of 40 V in color cathode ray tubes.
Figure 16:
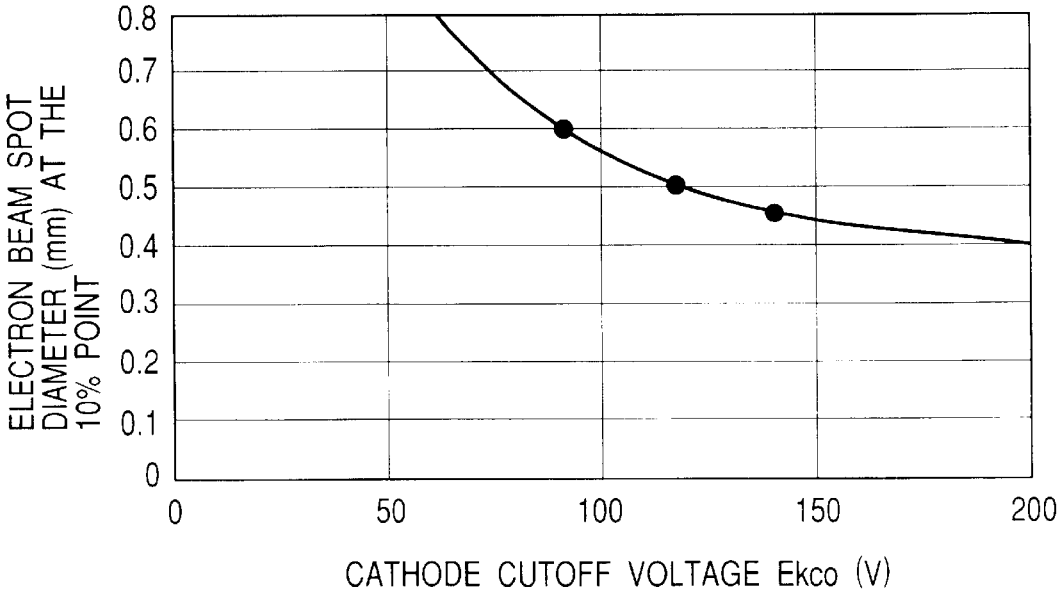
FIG. 16 is an illustration of an example of a relationship between cutoff voltages and electron beam spot diameters for color cathode ray tubes.

FIG. 14 is a schematic illustration of an example of a color image reproducing system in accordance with the present invention. The same reference numerals as utilized in FIG. 13 designate corresponding or functionally similar portions in FIG. 14. In FIG. 14, reference numeral 14 denotes a television antenna, 15 is a personal computer, 16 is a video tape recorder, 17 is a terminal of a TV phone, and 18 is a telephone switchboard.

When one of the various kinds of video signals indicated in FIG. 14 is supplied to this color image reproducing system, the color image reproducing system is capable of reproducing an image display most suitable to characteristics of the incoming video signals by selecting a suitable one of the plural driving modes by switching.

Incidentally, video signals from the television antenna 14 or video tape recorders are not limited to one in kind, and the video signals to be supplied to the input terminals 12*a* to 12*d* of the driving circuit 12 for the color cathode ray tube are not limited to those indicated in FIG. 14, and the switching circuit can be modified to correspond to other kinds of video signals.

The above embodiments have been explained in connection with reception of color video signals, but it is needless to say that the present invention is applicable to a monochrome image display.

As explained above, in accordance with the present invention, a color image reproducing device is provided with a plurality of combinations of a cathode bias voltage and voltages applied on the electrodes of an electron gun of a cathode ray tube, selects the most suitable one of plural driving modes according to the kind of incoming video signals, and thereby is capable of producing both a high-quality high-definition display and a high-quality high-brightness and high-contrast display, and therefore one color image reproducing device alone is capable of providing a display suitable to the display monitor of information terminals, the color television receiver, and other various video signal systems.

What is claimed is:

1. A color cathode ray tube having a phosphor screen and an electron gun, said electron gun comprising:

a triode section including three transversely-spaced in-line cathodes adapted to be supplied with video signals, a first grid electrode and a second grid electrode arranged in the order named; and a plurality of electrodes for focusing three electron beams emitted from said triode section onto said phosphor screen, wherein the following inequalities are satisfied:

$$E \leqq 1.4A - 0.2B - 2.7C - 2D,$$

$$A \leqq 0.35\ mm,$$

where

A (mm) is a diameter of an electron-beam transmissive aperture in said first grid electrode, B (mm) is a diameter of an electron-beam transmissive aperture in said second grid electrode, C (mm) is a thickness of a portion of said first grid electrode immediately surrounding said electron-beam transmissive aperture in said first grid electrode, D (mm) is a spacing between said three transversely-spaced in-line cathodes and said electron-beam transmissive aperture in said first grid electrode, and E (mm) is a spacing between said first grid electrode and said second grid electrode.

* * * * *